United States Patent [19]

Andersen

[11] 4,269,392

[45] May 26, 1981

[54] JACK MECHANISM

[76] Inventor: Henry L. Andersen, Rte. 1, Box 152, Goldendale, Wash. 98620

[21] Appl. No.: 76,327

[22] Filed: Sep. 17, 1979

[51] Int. Cl.[3] ..... B66F 3/02

[52] U.S. Cl. ..... 254/95; 254/104

[58] Field of Search ..... 254/104, 42, 66, 95; 248/188.2, 637

[56] References Cited

U.S. PATENT DOCUMENTS

| | | | |
|---|---|---|---|
| 386,035 | 5/1888 | Bell | 254/104 |
| 657,252 | 9/1900 | Slauson | 254/42 |
| 1,348,851 | 8/1920 | Cook | 254/104 |
| 1,557,740 | 10/1925 | Sullivan | 254/42 |

*Primary Examiner*—Robert C. Watson

*Attorney, Agent, or Firm*—Eugene M. Eckelman

[57] ABSTRACT

A pair of spring connected jack members have opposed faces. One of such members has one or more longitudinally extending ramps engageable by pinion gears or the like secured on cross shafts movable freely between the two jack members. Also supported on the cross shafts but for free rotation on such shafts are pairs of rollers engageable with tracks on opposite faces of the jack members. The tracks are parallel with the ramps and are offset from each other in an arrangement such that one of the rollers in a pair engages one of the tracks on a first of the jack members but is disengaged from the opposite jack member and the other of such roller in the pair engages the track of such opposite jack member but is disengaged from the first jack member. The cross shafts have wrench engaging ends for rotating the pinion gears so that they will travel along the ramps to expand or contract the two jack members relative to each other. Releasable brakes are associated with the pinion gears to hold them in a set position along the ramp.

3 Claims, 5 Drawing Figures

JACK MECHANISM

FIELD OF THE INVENTION

This invention relates to new and useful improvements in jack mechanisms.

SUMMARY OF THE INVENTION

According to the present invention and forming a primary objective thereof, a jack mechanism is provided having a novel structural arrangement which is substantially friction free whereby spreading forces are provided by using a minimum of input energy.

In carrying out the invention, a pair of jack members having opposed faces are movable toward and away from each other. One of said members has a longitudinally extending ramp engageable by rotatable drive means in a gripping engagement so that said drive means will be driven along said ramp when rotated to expand or contract the jack. Such rotatable drive means are secured on cross shafts, and also supported on such cross shafts but freely rotatable thereon are pairs of rollers one of which engages a first of said jack members but is disengaged from the opposite member and the other of which engages said opposite member but is disengaged from said first member. The cross shafts have wrench engaging means for rotating said shafts and for moving the drive means along the ramps to spread and retract the jack. Releasable brake means are employed to hold the drive means at selected positions along the ramps. The invention will be better understood and additional objects and advantages will become apparent from the following description taken in connection with the accompanying drawings.

DETAILED DESCRIPTION OF A PREFERRED EMBODIMENT

Figure 1:
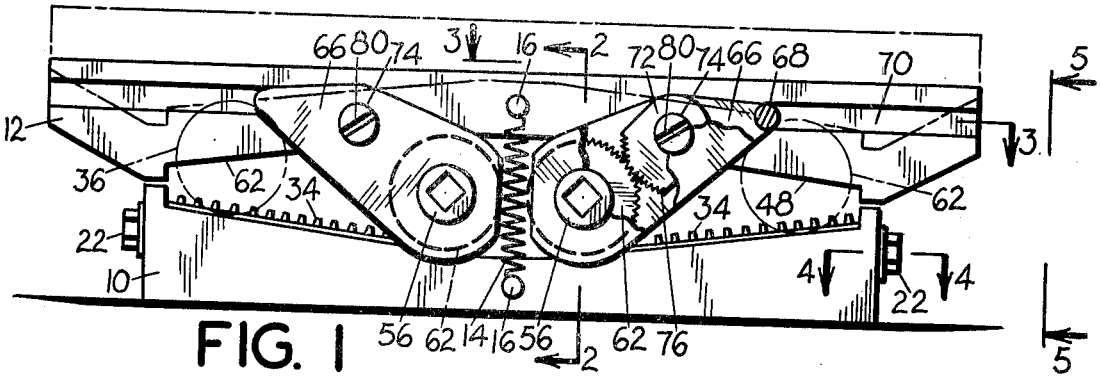
FIG. 1 is a side elevational view of the present jack mechanism, an expanded condition of the jack being shown in broken lines.

The present jack comprises a pair of members 10 and 12 arranged for movement toward and away from each other by mechanism to be described. The member 10 may comprise the base of the jack and the member 12 may comprise the expanding member. It is to be understood, however, that the jack does not have to be used for vertical lifting since the two members 10 and 12 may expand or contract horizontally or other directions if desired. The two members are urged toward each other by a tension spring 14 on each side having opposite anchor points 16 to the two members.

Figure 3:
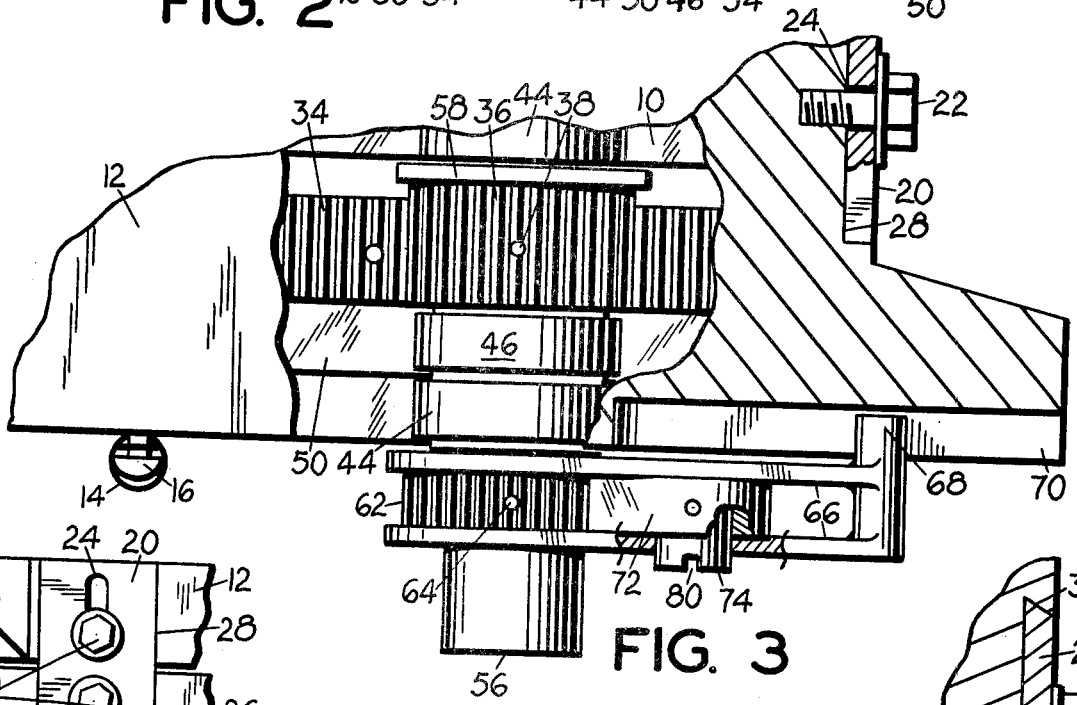
FIG. 3 is a fragmentary enlarged plan view, partly broken away, taken on the line 3—3 of FIG. 1.
Figure 5:
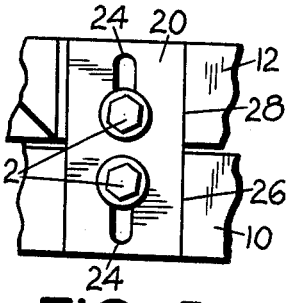
FIG. 5 is an enlarged fragmentary end elevational view taken on the line 5—5 of FIG. 1.
Figure 4:
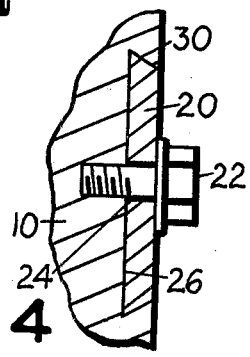
FIG. 4 is an enlarged fragmentary sectional view taken on the line 4—4 of FIG. 1.

The two members 10 and 12 have guided expanding and contracting movement by end plates 20, FIGS. 3–5, set in grooves in the ends of the two members and held therein by bolts 22 extending through vertically elongated slots 24 and threadedly engaged in the respective jack members. The grooves in the member 10 are designated by the numeral 26, FIG. 5, and the grooves in the member 12 are designated by the numeral 28, FIGS. 3 and 5, the grooves 26 and plates 20 having a dove-tail connection 30 to prevent stresses against the bolts 22. Such bolts are sufficiently loose to allow slidable movement of the two members 10 and 12 in their grooves 26 and 28; and in addition the bolts 22 in the upper member are sufficiently loose to allow one end of the jack to be tipped relative to the other end in the event that the jack ends are not raised uniformly.

Spreading or expanding means for the jack comprise two longitudinally extending ramps or drive portions 34 on the member 10. These ramps are parallel with each other and incline from a central point toward the other member in opposite directions from such central point. Pairs of drive wheels 36, secured as by pins 38 on respective cross shafts 40, FIG. 2, have driving or gripping engagement on the ramps 34.

Figure 2:
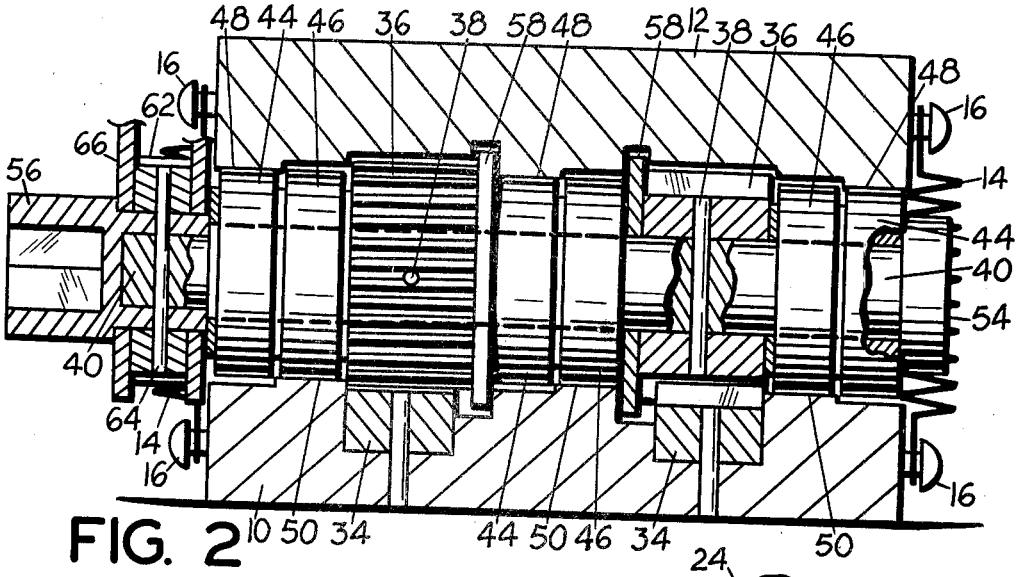
FIG. 2 is an enlarged cross sectional view taken on theline 2—2 of FIG. 1.

The means which provide engagement between the members 10 and 12 comprise pairs of rollers 44 and 46 supported for free rotation on shafts 40. With particular reference to FIG. 2, the rollers 44 engage longitudinal track surfaces 48 on the member 12 but are disengaged from the member 10. The rollers 46 engage longitudinal track surfaces 50 on the member 10 but are disengaged from the member 12.

Shafts 40 have a head 54 on one end and a wrench engaging portion 56 on the other end. In the operation of the jack, a suitable tool which may be hand or power operated is engaged with the portion 56, and by rotating the two shafts 40 in opposite directions the drive wheels 36 are moved along the inclined ramps 34 which in turn causes the rollers 44 in their engagement with the two members to move the two members 10 and 12 relative to each other. The jack is shown in contracted condition by full lines in FIG. 1 and is shown in an expanded condition by broken lines in this same figure. Since the pairs of rollers have single engagement with one or the other of the members, there is no drag on their rotation and a minimum amount of energy is necessary to expand the jack. Drive wheels 36 may comprise conventional pinion gears and the ramps 34 may comprise gear racks. The facing surfaces of the two members 10 and 12 are suitably contoured to receive the drive wheels and rollers, as best seen in FIG. 2. Suitable washers 58 are employed as necessary to maintain the parts in proper position.

Releasable brake means are provided to maintain the drive wheels 36 at selected points along the ramps 34, and for this purpose gear wheels 62, FIGS. 1—3, are secured, such as by pins 64, non-rotatably on the shafts 40 between the wrench engaging portions 56 and the body of the jack. These gear wheels 62 are mounted in housings 66 which receive the shafts 40 for free rotation and which have stabilized longitudinal guided movement along the jack by means of fingers 68 slidably guided in longitudinal side opening slots 70 in the member 12.

Housings 66 carry a locking lug 72 therein, such lugs being secured on cross shafts 74 rotatably supported in the housings. One end of the locking lugs 72 has teeth 76 engageable with the teeth of its gear wheel 62. The teeth 76 assume an arcuate contour and such arcuate contours are eccentric with the axes of their shafts 74 in an arrangement such that locking lugs 72 freely rotate off the gear wheels 62 as the latter roll up the ramps 34 but jam against the wheels 62 in the opposite direction. Thus, wheels 62 can be operated up the ramps 34 but are braked against movement in the opposite direction. Shafts 74 extend beyond the housing 66, FIG. 3, and have slots 80 therein which are arranged to receive a tool such as a screwdriver for releasing the brakes when desired, such being accomplished first by applying a slight rotative force to the shafts for movement up the ramps 34 and then holding the locking lugs 72 out of engagement with the wheels 62 to allow the desired retracting movement of the jack.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A jack mechanism comprising (a) a pair of members movable toward and away from each other and having opposed faces, (b) one of said members having a longitudinally extending ramp on its face which is inclined relative to said other member, (c) rotatable drive means disposed between said members engageable with said ramp, (d) said drive means and the surface of said ramp having a gripping engagement with each other so that said drive means will be driven along said ramp when rotated, (e) a track surface on each of said opposed faces extending parallel with the direction of travel of said drive means, (f) said track surfaces being offset from each other, (g) spreading means including a shaft extending between said members and a pair of rollers on said shaft one of which engages one of said track surfaces and is disengaged from the opposite face and the other of which engages the other of said track surfaces and is disengaged from the opposite face, (h) and means operatively connecting said spreading means with said drive means whereby said spreading means forces said members apart as said drive means moves along said ramps.

2. The jack mechanism of claim 1 including a pair of said ramps disposed in laterally spaced relation and a pair of said drive means engageable with respective ones of said ramps, and at least two of said pairs of rollers and corresponding track surfaces.

3. The jack mechanism of claim 1 including releasable brake means associated with said drive means arranged to hold said drive means at selected positions along said ramp.

* * * * *